US009452470B2

(12) United States Patent
Castle et al.

(10) Patent No.: US 9,452,470 B2
(45) Date of Patent: Sep. 27, 2016

(54) SYSTEM AND METHOD FOR HIGH TEMPERATURE DIE CASTING TOOLING

(71) Applicant: United Technologies Corporation, Hartford, CT (US)

(72) Inventors: Lea Kennard Castle, Vernon, CT (US); Mario P. Bochiechio, Vernon, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/518,694

(22) Filed: Oct. 20, 2014

(65) Prior Publication Data

US 2015/0037602 A1 Feb. 5, 2015

Related U.S. Application Data

(62) Division of application No. 13/173,602, filed on Jun. 30, 2011, now Pat. No. 8,863,817.

(51) Int. Cl.

| | |
|---|---|
| ***B22D 17/14*** | (2006.01) |
| ***B22D 17/20*** | (2006.01) |
| ***B22D 17/22*** | (2006.01) |
| ***B22D 30/00*** | (2006.01) |
| ***B22D 17/02*** | (2006.01) |
| ***B22D 21/00*** | (2006.01) |
| ***B22D 21/02*** | (2006.01) |

(Continued)

(52) U.S. Cl.

CPC ..... *B22D 17/02* (2013.01); *B22C 9/067* (2013.01); *B22C 9/088* (2013.01); *B22D 17/14* (2013.01); *B22D 17/145* (2013.01); *B22D 17/20* (2013.01); *B22D 17/22* (2013.01); *B22D 21/005* (2013.01); *B22D 21/025* (2013.01); *B22D 30/00* (2013.01); *B22D 17/2218* (2013.01); *C22C 19/03* (2013.01); *Y10T 428/12389* (2015.01)

(58) Field of Classification Search

CPC .... B22D 17/02; B22D 17/14; B22D 17/145; B22D 17/20; B22D 17/22; B22D 17/2218; B22D 30/00; B22C 9/067; B22C 9/088

USPC ..... 164/113, 122.1, 305

See application file for complete search history.

(56) References Cited

U.S. PATENT DOCUMENTS 4,436,140 A 3/1984 Ebisawa et al.
4,787,436 A * 11/1988 Ozeki et al. ..... B22D 17/145 164/305

(Continued)

FOREIGN PATENT DOCUMENTS

JP 2005193241 7/2005
JP 2009269073 A 11/2009

*Primary Examiner* — Kevin P Kerns
(74) *Attorney, Agent, or Firm* — Kinney & Lange, P.A.

(57) ABSTRACT

A die casting and a method for die casting a metal having a melting temperature of at least 1500° F. (815° C.) are disclosed. A molten volume of metal is injected to a casting die which includes a main cavity corresponding to an as-cast structure, a first reservoir, and a first runner arrangement. The first runner arrangement is configured to fluidly communicate molten metal between the first reservoir and the main cavity. After the injecting step, the casting die is sealed. The injected molten volume of metal is equiaxially solidified generally from a first portion of the main cavity distal to the first reservoir toward a second portion of the main cavity proximal to the first reservoir. During the equiaxial solidifying step, the main cavity is backfilled with at least a portion of the injected molten volume via the first runner arrangement.

11 Claims, 3 Drawing Sheets

(51) Int. Cl.

| | |
|---|---|
| ***B22C 9/06*** | (2006.01) |
| ***B22C 9/08*** | (2006.01) |
| *C22C 19/03* | (2006.01) |

(56) References Cited

U.S. PATENT DOCUMENTS 4,987,947 A * 1/1991 Ozeki et al. ..... B22D 17/145 164/305
4,997,026 A 3/1991 Ozeki et al.
5,896,912 A * 4/1999 Monroe et al. ..... B22C 9/28 164/119
5,913,356 A * 6/1999 Muramatsu ..... B22D 17/145 164/305
6,158,495 A * 12/2000 Bigger ..... B22D 17/145 164/155.1
6,845,810 B2 * 1/2005 Siak et al. ..... B22C 9/02 164/244
6,986,380 B1 1/2006 Rice et al.
7,017,649 B2 3/2006 Kubota
7,654,305 B2 2/2010 Hirao
7,686,066 B2 3/2010 Hirao
7,770,627 B2 8/2010 Wang et al.
7,793,705 B2 9/2010 Kuo
7,815,774 B2 * 10/2010 Tsuura et al. ..... B22C 1/167 162/145
8,061,409 B2 * 11/2011 Iwasaki et al. ..... B22C 9/02 164/29
8,186,417 B2 * 5/2012 Ribeiro ..... B22D 13/06 164/114
8,336,600 B2 12/2012 Baumgartner
8,863,817 B2 * 10/2014 Castle et al. ..... B22D 17/14 164/305

* cited by examiner

SYSTEM AND METHOD FOR HIGH TEMPERATURE DIE CASTING TOOLING

CROSS-REFERENCE TO RELATED APPLICATION(S)

This application claims priority as a divisional application under 35 U.S.C. §121 to earlier filed U.S. patent application Ser. No. 13/173,602 entitled "SYSTEM AND METHOD FOR HIGH TEMPERATURE DIE CASTING TOOLING" filed on Jun. 30, 2011, and issued as U.S. Pat. No. 8,863,817 on Oct. 21, 2014, the entirety of which is hereby incorporated by reference.

BACKGROUND

The invention relates generally to systems and methods for metal casting, and more specifically to systems and methods for high temperature die casting.

Certain metals and alloys have previously responded better to pressurized die casting while others are better cast using investment processes. Lower melting temperatures of aluminum-based and magnesium based alloys, for example, as well as favorable solidification pathways permitted the use of temperature resistant injection molds whereby the molten metal is solidified with a minimum of shrinkage or defects. Alloys with higher melting temperatures such as titanium-based, nickel-based, and cobalt-based alloys and superalloys have traditionally been investment cast.

Attempts to die cast higher temperature alloys have been often thwarted due in part to the difficulty in finding suitable materials for casting dies that could withstand the necessary temperatures and pressures. Even when a suitable casting die material is available, the alloy cannot be superheated far above its melting temperature without compromising the die. This offers a much smaller margin of error and a narrower temperature range available for solidification. As a result, traditional pressurized die castings using these high temperature alloys frequently have excessive defects including shrinkage and knit lines, also known as cold shuts. Most of these defects then result in scrapping out the casting, unnecessarily costing time, effort, and money to recycle and recast the parts until a suitable casting is finally formed.

SUMMARY

A casting die comprises a main cavity, a first reservoir and a first vent. The main cavity has a first interior volume for receiving a first molten volume of metal. The first reservoir is in serial fluid communication with the main cavity for storing a first molten backfill volume of metal to accommodate solidification shrinkage in the main cavity. The first vent is in serial fluid communication with the first reservoir.

A metal casting comprises an as-cast portion, a runner portion, and a reservoir portion. The as-cast portion corresponds to a final part. The runner portion projects from a first surface of the as-cast portion. The reservoir portion projects from the runner portion. The as-cast portion has an equiaxial solidification direction from a location distal to the first surface to a location proximal to the first surface.

A method for die casting a metal having a melting temperature of at least 1500° F. (815° C.) is disclosed. A molten volume of metal is injected to a casting die, which includes a main cavity corresponding to an as-cast structure, a first reservoir, and a first runner arrangement. The first runner arrangement is configured to fluidly communicate molten metal between the first reservoir and the main cavity.

After the injecting step, the casting die is sealed. The injected molten volume of metal is equiaxially solidified generally from a first portion of the main cavity distal to the first reservoir toward a second portion of the main cavity proximal to the first reservoir. During the equiaxial solidifying step, the main cavity is backfilled with at least a portion of the injected molten volume via the first runner arrangement.

DETAILED DESCRIPTION

Figure 1:
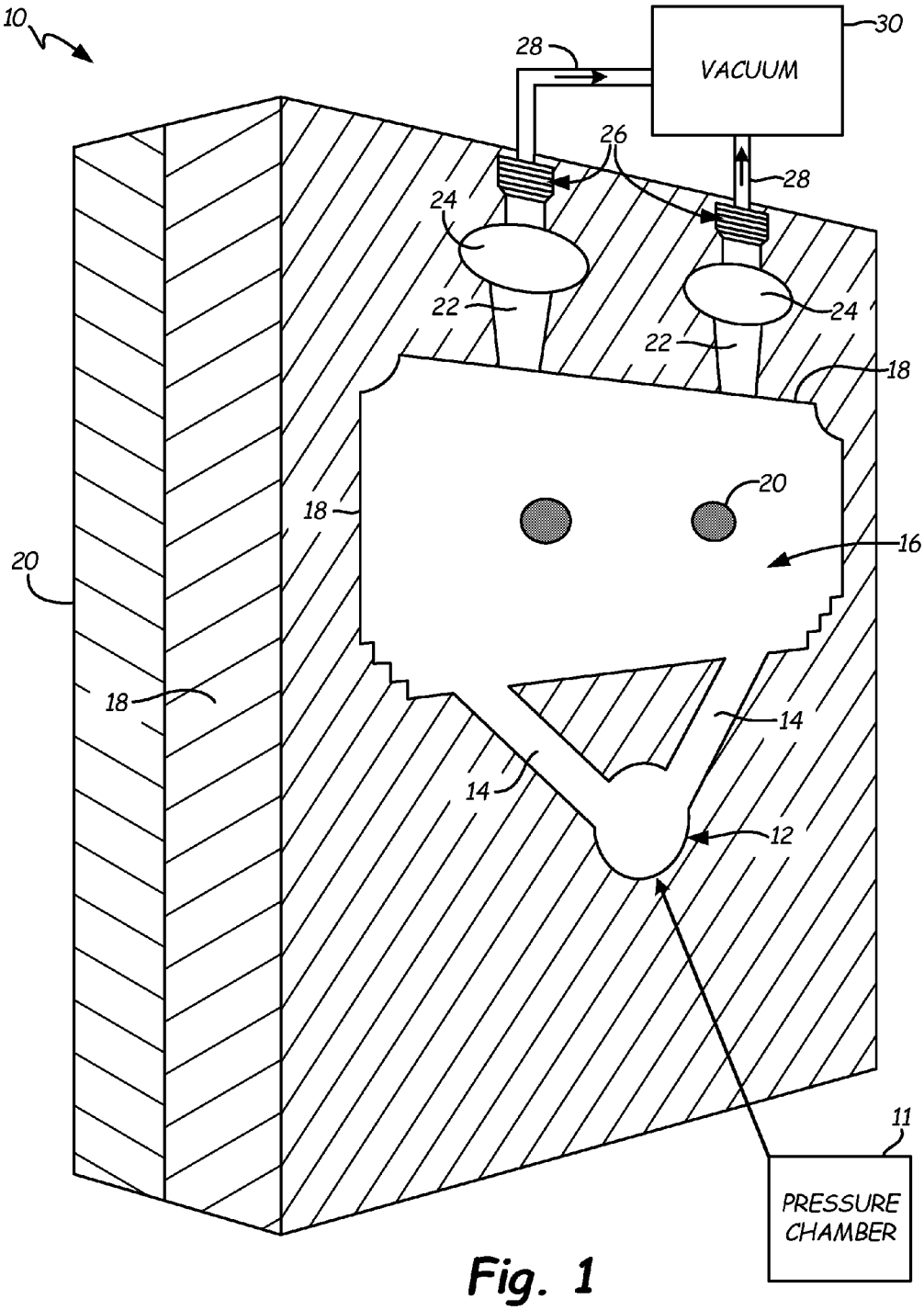
FIG. 1 schematically depicts one example of a metal injection casting die.

FIG. 1 shows casting die 10, pressure chamber 11, shot sleeve 12, lower in-gates 14, main part cavity 16, walls 18, features 20, wedge runners 22, boule reservoirs 24, chill vents 26, vapor passages 28, and vacuum source 30.

FIG. 1 is a cross-section of pressure casting die 10. Die 10 includes several riser and gating elements to facilitate solidification while minimizing defects occurring during solidification of main part cavity 16. As die 10 is mounted to an injection molding machine (not shown). Since molding machines vary significantly from one another, features of the machine helpful to the context of die 10 are simplified into block form. Pressure chamber 11 is configured to rapidly inject molten metal into die 10 via shot sleeve 12. Pressure chamber 11 is usually placed as close as possible to shot sleeve 12 but is shown in block form in FIG. 1 to avoid interference with the view of die 10.

Lower in-gates 14 regulate the flow rate of metal from shot sleeve 12 into main part cavity 16 to minimize turbulence. As is known in the art, turbulence from rapid filling of cavity 16 can exacerbate problems with dissolving air bubbles including formation of oxides and/or voids in the solidified part. The geometry of cavity 16 is defined by walls 18 and 3-D features 20. In this example, first and second wedge runners 22 also provide serial fluid communication between die 10 and respective first and second boule reservoirs 24. In this example, first and second boule reservoirs 24 are similarly in respective serial fluid communication with first and second chill vents 26. During injection, vapor in casting die 10 leaves via vapor passages 28. In this example, natural evacuation of vapor in die 10 can be aided by vacuum source 30, shown in block form. However, in alternative embodiments, vacuum source 30 can be omitted and vents 26 can be open to the environment until sealing of die 10.

In this example, boules 24 are placed serially between respective vents 26 and main part cavity 16 and serve as additional reservoirs for molten metal originally injected into shot sleeve 12. This metal backfills main part cavity 16 upon sealing of chill vents 26 and during solidification as explained below.

When die casting lower temperature alloys, additional riser and runner structures in the die merely result in more waste and do not markedly improve casting quality. Apart from relatively small pathways used solely to transport escaping gases to the vent as the metal fills the die cavity, dies for more traditionally die-cast alloys like aluminum and magnesium do not include reservoir or runner structures serially aligned with the main cavity. Risers are not used in pressurized casting dies due to residual injection pressure and thermal energy in the die of the metal being sufficient to fill defects and shrinkage that would otherwise occur during solidification.

When used in other casting dies like non-pressurized dies, risers are not placed in fluid communication with both the main cavity and the vent or sealing means. They may be placed above or around the main cavity structure, but arranging risers serially with regular vents complicates the operation of both structures. Risers in pressurized dies for aluminum-based and magnesium-based castings are unnecessary with the relatively low casting temperatures required.

High temperature alloys have been traditionally cast using an investment or lost wax technique which use refractory ceramics and other sacrificial high temperature mold materials. These molds have extremely high melting temperatures, low thermal conductivity, and relatively are chemically inert to the alloys being cast therein. Thus investment casting has been preferred from a technical standpoint for many higher temperature alloys. However, investment casting is a labor- and cost-intensive process with each casting mold being destroyed after a single casting.

In contrast, die casting dies can be reused several times before being retired. These same materials in the high-temperature category, including titanium-based, nickel-based, and cobalt-based alloys, only permit a short excursion above their relatively high melting temperatures (at least about 1500° F./815° C.) before the die itself is compromised by the superheated molten metal. The alloy must be kept at a temperature such that the die can withstand the processing temperatures and pressures without any deformation or damage.

Due in part to the high melting temperatures of certain alloys, the solidification range can be less than about 200° F. (about 110° C.) between the beginning of crystallization and final solidification. In certain embodiments, the range can be less than about 125° F. (about 70° C.). In certain of those embodiments, the range is on the order of about 55° to about 80° F. (about 30° to about 45° C.). The solidification range can also be determined by the phase diagram of the particular alloy composition and cooling rate. Thus, using a traditional die casting die with these high temperature alloys results in very compressed solidification timing. In contrast, traditional die casting alloys (like aluminum-based and magnesium-based alloys) solidify over a larger range and at lower overall temperatures, giving the molten metal plenty of time to reach the solidification front in a die having a traditional geometry, obviating the need for risers or other similar structures, particularly above the main cavity.

Instead, die casting die 10 includes features to quickly fill in the solidification fronts during the relatively rapid solidification of high temperature alloys. This results in some additional waste, scrapping, due to the extra gating and risers, as well as more complexity in forming the casting die to include these features. However, many castings with complex geometries using high melting temperature alloys have excessive scrap rates, which can be on the order of 80-90%. This is due in substantial part to difficulty in preventing cold shuts and shrinkage in the final part. With casting die 10, the scrap rate can be reduced by half or more, more than making up for the additional cost and effort of removing and scrapping out additional structures from the casting.

Figure 2A:
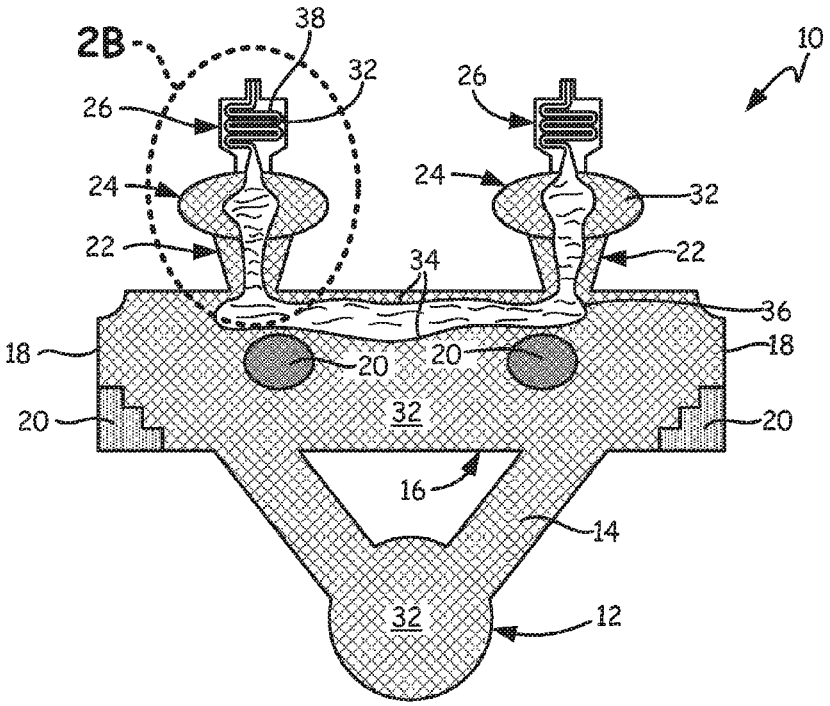
FIG. 2A shows a cross-section of half the casting die of FIG. 1.
Figure 2B:
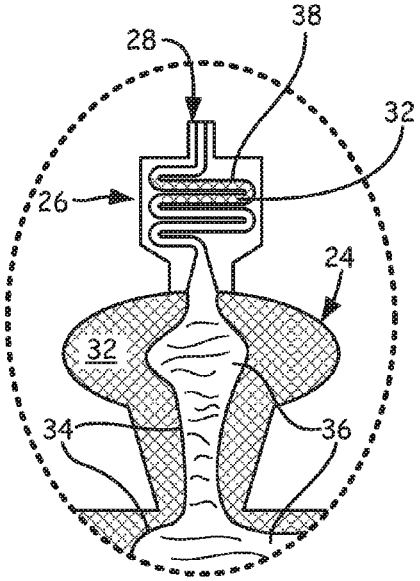
FIG. 2B is a magnified view of a portion of FIG. 2A.

FIG. 2A shows die 10, shot sleeve 12, lower in-gates 14, main part cavity 16, walls 18, features 20, wedge runners 22, boule reservoirs 24, vents 26, vapor passages 28, solidified metal 32, solidification front 34, molten metal 36, and chill vent passages 38. FIG. 2B is a magnified view of a portion of FIG. 2A.

FIG. 2A is a cross-section of metal filled die 10 just prior to completion of solidification. As is known in the art, injection dies often have two halves, a movable ejector half and a stationary cover half. The cross-section shown in FIG. 2A can be either half as the geometries are substantially similar with a few possible variations. Such variations are not relevant or material to the examples discussed herein, but being known to those skilled in the art of metal casting, can be readily integrated into various embodiments of the invention.

While this example for illustrative purposes includes first and second sets of wedge runners 22 providing respective serial fluid communication to first and second boule reservoirs 24, it will be appreciated that the number, size, and position of these two sets of backfill structures can vary based on the geometry and solidification characteristics in a given casting die 10. Casting die 10 can be readily adapted to include more or less than two reservoirs with two corresponding runner arrangements. For example, smaller parts or parts with wider solidification ranges may experience less shrinkage in main cavity 16 and thus will only require a single arrangement of wedge runner 22 and boule reservoir 24. In certain alternative embodiments, at least one of the boule reservoirs 24 is not in further serial fluid communication with a chill vent 26.

In this example, solidification has already proceeded through shot sleeve 12 and in-gates 14 before proceeding into main part cavity 16. Contrary to traditional die casting, boule reservoirs 24 retain and provide additional molten metal 36 via fluid communication with main part cavity 16 as solidification front 34 proceeds inward. During mold filling and solidification in main part cavity 16, first and second wedge runners 22 each fluidly communicate molten metal 36 between cavity 16 and respective first and second boule reservoirs 24.

In this instance, solidification front 34 proceeds from a distal portion of cavity 16 to a proximal portion of cavity 16. In this example, proximal and distal are defined relative to boule reservoirs 24. Molten metal 36 in boule reservoirs 24 continues to backfill cavity 16 as the previously molten metal 36 in cavity 16 shrinks into solidified metal 32. Part shrinkage typically occurs through three different stages, liquid shrinkage, phase change shrinkage, and solid shrinkage. The most significant shrinkage will occur during the phase transition from liquid to solid form, which is addressed by the structures and methods described herein.

Due to the higher temperatures involved, there will often be substantial contraction of the as-cast part (shown in FIG. 3) as a result of the large temperature and possible pressure differences between solidification and ambient conditions. Thus it is to be noted that main part cavity 16 should be sized to account for this post-solidification contraction.

Chill vents 26 provide a similar effect as vacuum valves by permitting a vacuum to be applied only during injection. Vacuum source 30 is shown in FIG. 1. The vacuum pulls vapor out of main part cavity 16, wedge runners 22 and boule reservoirs 24 via respective chill vents 26 and vapor passages 28. To close off flow immediately after injection, chill vents 26 respectively include narrow fluid passages 38 with a large amount of surface area relative to passage volume. Once molten metal 36 reaches vent 26, heat is quickly removed in narrow vent passages 38, causing the metal to quickly solidify and block further molten metal 36 from flowing through vent 26. Once the vacuum can no longer reach the insides of die 10, molten metal 36 then returns to backfill boules 24, feeding main cavity 16. Vents 26 can be manufactured from a highly thermally conductive metal or alloys that are similar or identical to that used for die casting die 10 and/or cavity walls 18.

Traditional die casting works with lower temperature materials having wider solidification ranges. These ranges make available a unified solidification front fed by molten metal having a sufficient opportunity to quickly fill in otherwise heat-deficient regions. Shrinkage is a normal part of solidification which is exacerbated when the material selected for die casting has a narrow solidification range. Without additional reservoir and vent features in serial communication with the main cavity, die cast alloys with high melting temperatures and narrow solidification ranges will proceed according to traditional die casting and solidify inwardly from the cavity walls. Due to the rapid solidification caused by a narrow solidification range, this results in several converging solidification fronts. As is known in the art, solidification fronts are relatively cold and when they converge from multiple directions, result in a knit line, also known as a cold shut. In contrast, boule reservoirs 24 backfill main cavity 16 in order to substantially maintain a single solidification front by minimizing large discontinuities in the grain structure.

Knit lines represent the convergence of discontinuous two or more solidification fronts. These are identified in castings as lines along the surface not attributable to other features of the die. They indicate the presence of a large surface through the interior of the casting where the part is not complete. The final casting appears to have been "knit" together. Other defects caused by rapid solidification include gas entrapment resulting in bubbles throughout the cast part. These bubbles end up as voids or pores in the as-cast part and can compromise its strength and quality. As described above, shrinkage of the as-cast part during solidification in the main cavity can also be problematic.

Using traditional lower temperature alloys, there are few if any knit lines, gas entrapment, or shrinkage in the as-cast parts. The higher superheat permitted with traditional die-cast alloys provides more room and time for gases to escape the casting cavity and for enough liquid material to travel to the solidification fronts. However, this is difficult to accomplish in traditional casting dies using high temperature alloys.

In many cases, metal 36 has a relatively low superheat even when injected into die 10. In some cases the superheat (temperature above the melting or solidification temperature) can be as low as about 55° F. to about 80° F. (about 30° C. to about 45° C.). In these instances, molten metal 36 requires a more controlled solidification front 34 to avoid knit lines, shrinkage, and other defects.

As can be seen here, multiple wedge runners 22 and boule reservoirs 24 are arranged in such a fashion as to promote generally equiaxial (e.g. bottom-up) solidification. As should be apparent, wedge runners 22 and boule reservoirs 24 are sized to retain enough molten metal 32 and continue to backfill cavity 16. They are configured in fluid communication between both main cavity 16 and respective chill vents 26. Once metal 36 has completely filled die 10 it solidifies in chill vent 26 to allow molten metal 36 to move back downward. Once solidification front 34 has proceeded through cavity 16, the remaining metal 32 in wedges 22 and boules 24 finally solidifies and "pulls" most of the shrinkage and other remaining defects that would otherwise end up in main cavity 16.

Die 10 is not specific to either a hot-chamber or a cold-chamber casting machine. In a cold-chamber machine the molten metal is provided to pressure chamber 11 by a ladle or other mechanical process before injection into shot sleeve 12. In a hot chamber machine, pressure chamber 11 is submerged in molten metal (not shown) and thus refills automatically after injection of shot sleeve 12.

In addition, the structures serially linking main cavity 16 and chill vents 26 have been described as wedge and boule shapes. However, it should be noted that any suitable geometry can be used in place of one or both structures. In the case of boules 24, other structures can be suitable for use as one or more reservoirs with the understanding that solidification is more likely to occur in geometries having a high ratio of surface area to volume. Thus rounded structures are shown, but other three-dimensional solids are also appropriate, so long as the aspect ratio (height to cross-sectional area) of the solid remains between about 0.5 to about 2.0. This will effectively minimize the volume required for the equivalent to boule reservoir 24. Similarly, as will be appreciated by one skilled in the art, substitute gating for wedges 22 should also have a sufficiently wide cross-sectional area so as to prevent solidification in that location prior to cavity 16.

To summarize an example of the casting process using embodiments of die 10, the following steps can be taken. A volume of molten metal is injected into main cavity 16 and boule reservoirs 24. This can be performed as a single injection via sleeve 12 and in-gates 14. The die is sealed, for example using vents 26 in serial communication with reservoirs 24 respectively disposed between cavity 16 and vents 26. Sealing can alternatively be performed by replacing chill vents 26 with vacuum valves or other structures equally well known in the art.

Figure 3:
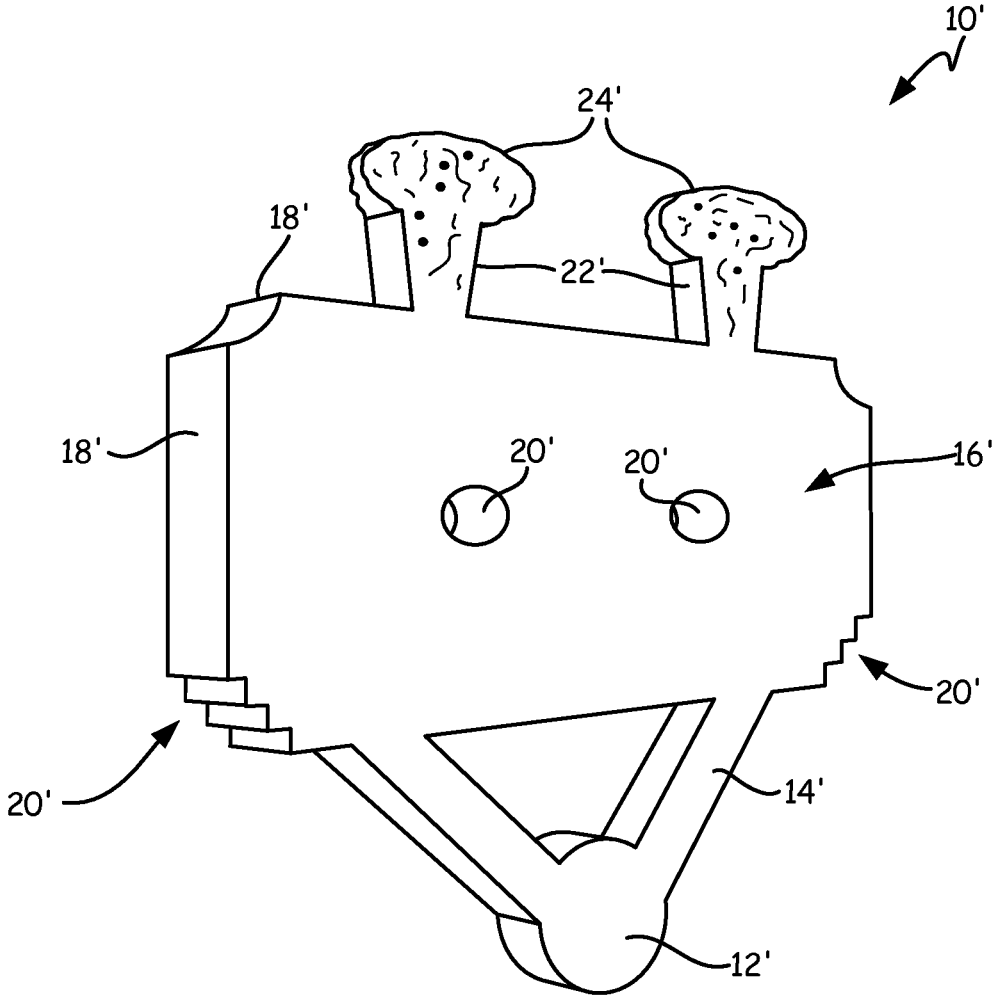
FIG. 3 depicts a casting made from the die in FIGS. 1 and 2.

FIG. 3 shows final casting 10' with biscuit 12', lower gating 14', as-cast part 16', surfaces 18', features 20', wedges 22', and boules 24'. Once the casting has solidified, part 10' is removed from die 10. Part 10' generally resembles the interior of die 10 shown in FIGS. 1 and 2, including main cavity 18, wedges 22, and boules 24. In this figure, it can be seen that the upper structures like wedge 22' and boules 24', both projecting from as-cast part 16' experienced nearly all of the shrinkage and porosity rather than in as-cast part 16'. This was done so that defects, cold shuts, and gas entrapment would occur in the sacrificial structures such as biscuit 12', gating 14', wedges 22', and boules 24'. These sacrificial structures projecting from various surfaces of as-cast part 16 are removed from the casting and recycled. Removal of the scrap can occur in any manner known in the art such as a pressing die shaped substantially like as-cast part 16'. In this example, as-cast part 16' is a generalized schematic of a blade outer air seal for a turbine section of a gas turbine engine. However, it will be appreciated that one skilled in the art having the benefit of this disclosure can produce high quality as-cast structures of varying geometries with minimal defects and scrap rates.

As described above, the metal alloy comprising final casting 10' can be any alloy suitable for casting. In certain embodiments, casting 10' can be any alloy that is a plurality by weight of one of titanium, iron, nickel, or cobalt. In certain embodiments, some casting alloys contain more titanium, iron, nickel, or cobalt, than any other constituent element, but the weight percentage of the predominant element in the alloy does not exceed 50%.

Metal alloys used to produce die casting 10' typically have melting points or ranges exceeding about 1500° F. (about 815° C.). In certain of those embodiments, casting 10' is a superalloy based on nickel, iron, or cobalt and having melting points or ranges exceeding about 2000° F. (about 1090° C.). In yet certain of those embodiments, casting 10' is a superalloy based on nickel or cobalt having melting points or ranges exceeding about 2300° F. (about 1250° C.). One example nickel-based superalloy with these characteristics is known commercially as Inconel 718 Plus®, the equivalent of which is available from multiple commercial suppliers.

Inconel 718 Plus® and its equivalents are characterized by a melting temperature of about 2420° F. (about 1330° C.), nickel content ranging between about 50.1 wt % and about 55.0 wt %, chromium content ranging from about 17.0 wt % to about 21.0 wt %, as well as substantial quantities of molybdenum, titanium, niobium, and iron. With its temperature and creep resistance, Inconel 718 Plus® is suitable for use in some of the highest temperature regions of gas turbine engines, including critical components of the combustor and the high-pressure turbine sections. It is also well-suited for many cryogenic applications.

While the example of casting 10' has been described with respect to higher temperature nickel-based, titanium-based, and cobalt-based alloys often having melting points exceeding about 1500° F. (about 815° C.), traditional lower temperature casting alloys like magnesium-based and aluminum-based alloys can also be used for casting 10'. However, as described above, scrap will be increased from the additional cast geometries. Nevertheless, in certain instances, it may be desirable to use these lower temperature alloys for testing or validation purposes, or as a cost savings when used with common main part geometries that are manufactured using a wide range of alloys.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method for die casting a metal having a melting temperature of at least 1500° F. (815° C.), the method comprising the steps of:

injecting a molten volume of the metal into an interior volume of a casting die, the casting die comprising a main cavity corresponding to an as-cast structure, a first reservoir having dimensions with an aspect ratio (height to cross-sectional area) between 0.5 and 2.0, and a first runner arrangement having at least one runner configured into one or more wedges serially connecting the first reservoir and the main cavity to fluidly communicate molten metal between the first reservoir and the main cavity, the molten volume sufficient for filling the main cavity, the first reservoir and at least a portion of the first runner arrangement;

venting vapor through a vent in serial fluid communication with the first reservoir, the vent having at least one passage for evacuating vapor from the interior volume;

after the injecting step and the venting step, sealing the casting die;

equiaxially solidifying the injected molten volume of metal, solidification proceeding generally from a first portion of the main cavity distal to the first reservoir toward a second portion of the main cavity proximal to the first reservoir; and during the equiaxial solidifying step, backfilling the main cavity with at least a portion of the injected molten volume via the first runner arrangement to substantially maintain a continuous solidification front within the main cavity.

2. The method of claim 1, wherein the metal is an alloy which comprises a plurality by weight of a metal element selected from the group consisting of: nickel, cobalt, and titanium.

3. The method of claim 2, wherein the alloy comprises a plurality by weight of nickel.

4. The method of claim 1, wherein the vent includes at least one chill vent in serial fluid communication with the first reservoir configured to perform the venting step and the sealing step.

5. The method of claim 1, wherein the casting die further comprises a second reservoir and a second runner arrangement having at least one runner configured to fluidly communicate molten metal between the second reservoir and the main cavity.

6. The method of claim 5, wherein the second reservoir has dimensions with an aspect ratio (height to cross-sectional area) between 0.5 and 2.0.

7. The method of claim 6, wherein the fluid communication of molten metal between the second reservoir and the main cavity is provided at least in part by one or more runners configured into one or more wedges connecting the second reservoir and the main cavity.

8. The method of claim 5, wherein the backfilling step includes backfilling the main cavity with at least a second portion of the injected molten volume via the second runner arrangement to substantially maintain the continuous solidification front within the main cavity.

9. The method of claim 5, wherein, prior to the solidification step, the molten volume is sufficient for filling the main cavity, the first runner arrangement, the second runner arrangement, at least a portion of the first reservoir, and at least a portion of the second reservoir.

10. The method of claim 1, wherein the metal has a solidification temperature range in the die of less than about 80° F. (about 45° C.), the solidification temperature range being a difference between temperature of the molten volume of metal upon injection, and a solidification temperature or melting temperature of the metal.

11. The method of claim 1, wherein a shape of the as-cast structure corresponds to a shape of a final turbine part.

* * * * *